US008168042B2

(12) United States Patent
Schmidt et al.

(10) Patent No.: US 8,168,042 B2
(45) Date of Patent: May 1, 2012

(54) BAR ARRANGEMENT FOR A MACHINE FOR THE PRODUCTION OF A FIBROUS WEB

(75) Inventors: Frank Schmidt, Heidenheim (DE); Ansgar Müller, Ulm (DE); Joachim Grabscheid, Gerstetten (DE)

(73) Assignee: Voith Patent GmbH, Heidenheim (DE)

( * ) Notice: Subject to any disclaimer, the term of this patent is extended or adjusted under 35 U.S.C. 154(b) by 20 days.

(21) Appl. No.: 12/827,368

(22) Filed: Jun. 30, 2010

(65) Prior Publication Data

US 2010/0314063 A1 Dec. 16, 2010

Related U.S. Application Data

(63) Continuation of application No. PCT/EP2009/058088, filed on Jun. 29, 2009.

(30) Foreign Application Priority Data

Jun. 30, 2008 (DE) ..... 10 2008 040 032

(51) Int. Cl.
*D21G 9/00* (2006.01)

(52) U.S. Cl. ..... 162/289

(58) Field of Classification Search ..... 162/289, 162/352, 354, 374, 301
See application file for complete search history.

(56) References Cited

U.S. PATENT DOCUMENTS

| | | | | |
|---|---|---|---|---|
| 5,078,835 | A * | 1/1992 | Schiel et al. | 162/352 |
| 5,695,613 | A | 12/1997 | Hentila et al. | |
| 6,183,602 | B1 * | 2/2001 | Iwata et al. | 162/301 |
| 6,361,657 | B2 * | 3/2002 | McPherson | 162/301 |
| 6,780,285 | B2 * | 8/2004 | Leinonen et al. | 162/352 |
| 7,005,039 | B2 * | 2/2006 | Bartelmuss et al. | 162/352 |
| 2008/0283209 | A1 | 11/2008 | Faix et al. | |

FOREIGN PATENT DOCUMENTS

| | | | |
|---|---|---|---|
| DE | 4019884 | A1 | 9/1992 |
| EP | 0 659 933 | A1 | 6/1995 |
| EP | 1 215 336 | A2 | 6/2002 |
| EP | 1 215 336 | B1 | 2/2005 |
| EP | 2 294 261 | B1 | 5/2011 |

OTHER PUBLICATIONS

English translation of International Search Report dated Sep. 21, 2009 for PCT/EP2009/058088 (2 pages). English translation of International Preliminary Report on Patentability dated Jan. 18, 2011 for PCT/ EP2009/058088 (7 pages).
English translation of Written Opinion (undated) of the International Searching Authority for PCT/EP2009/058088 (6 pages).

* cited by examiner

*Primary Examiner* — Mark Halpern
(74) *Attorney, Agent, or Firm* — Taylor IP, P.C.

(57) ABSTRACT

The invention relates to a bar arrangement for a machine for producing a fibrous web. The bar arrangement according to the invention is characterized by at least one restoring mechanism for bringing the mobile bar from the operating position into the rest position. The at least one restoring mechanism comprises at least one guided piece arranged on the mobile bar on the exterior and alongside thereof, said piece having an inclined contact surface the incline of which is directed at an angle ($\alpha$) in the range of 5 to 60°, preferably of 20 to 45°, especially of 25 to 35°, relative to the longitudinal direction of the mobile bar, at least one guiding piece on the interior of the C-shaped guiding unit, which has a preferably inclined guide surface that can be brought in contact with the inclined contact surface of the guided piece arranged on the exterior and alongside thereof when the mobile bar is brought from the operating position into the rest position, and at least one displacement device for displacing the mobile bar in its longitudinal direction which acts upon the mobile bar, preferably the face thereof, and which can preferably be controlled/regulated.

33 Claims, 6 Drawing Sheets

BAR ARRANGEMENT FOR A MACHINE FOR THE PRODUCTION OF A FIBROUS WEB

CROSS REFERENCE TO RELATED APPLICATIONS

This is a continuation of PCT application No. PCT/EP2009/058088, entitled "BAR ARRANGEMENT FOR A MACHINE FOR PRODUCING A FIBROUS WEB", filed Jun. 29, 2009, which is incorporated herein by reference.

BACKGROUND OF THE INVENTION

1. Field of the Invention

The invention relates to a bar arrangement for a machine for the production of a fibrous web, especially a paper, cardboard or tissue web, which extends transversely to the machine direction and which comprises at least one fixed structure which is mounted directly or indirectly to a frame of the machine; at least one movable bar which is connected preferably indirectly with the fixed structure, relative to which it is preferably movable by means of a controllable/adjustable actuation device, at least between an inoperative position and an operating position in which the movable bar can be pressed against an element by means of a selectable contact force; and at least one fixed guide device which is mounted rigidly on the fixed structure or directly or indirectly on the frame of the machine and which has a guiding effect upon the movable bar and which includes several fixed c-shaped guide units located at a distance from each other, which surround the movable bar on one side in its lower area, at least in sections, with at least one fixed guide arm.

2. Description of the Related Art

The invention further relates to a wire section for a machine for the production of a fibrous web and a machine for the production of a fibrous web. The fibrous web can in particular be a paper, cardboard or tissue web.

A bar arrangement of this type is known for example from the German disclosure document DE 40 19 884 A1. The movable bar described in this document is a forming bar and the element is a forming wire located in the area of a twin wire zone in a twin wire section. This bar arrangement comprises a fixed guide arrangement which guides the movable bar, especially the forming bar and which includes several fixed c-shaped guide units located at a distance from each other, which surround the movable bar, especially the forming bar on one side in its lower area, at least in sections, with at least one fixed guide arm.

The movable bar, in particular the forming bar disclosed in the aforementioned documentation serves among other uses to scrape away and remove water from an element, particularly a forming wire shortly after the start of the sheet formation process in a machine for the production of a fibrous web, especially a paper, cardboard or tissue web. In addition it exerts an impulse upon the fiber/water suspension in order to thereby exercise targeted influence on the sheet characteristics. In its operating position the movable bar, in particular the forming bar is for this purpose positioned and preferably pressed against the element at a controlled, or respectively adjusted selectable contact force. The positioning and lastly the pressing contact of the movable bar, particularly the forming bar, preferably the lifting movement of the movable bar, particularly the forming bar is generally conducted by an actuation device, especially by one or two tubes which are filled with a gaseous or liquid medium and which move the movable bar, particularly the forming bar forward into the operating position.

For maintenance purposes, for example replacement of the element, especially wire replacement or its own replacement, the movable bar, particularly the forming bar must be capable of being pulled back from the element, particularly from the forming wire and capable of being brought into an inoperative- or servicing position. Generally this occurs through deactivation of the actuation device and the effect of gravitation upon the movable bar, particularly the forming bar. Due, for example to the effects of frictional forces and/or contamination in the guide areas of the bar arrangement, and a possible unfavorable installation position of the bar arrangement it cannot always be assured that the movable bar, particularly the forming bar can be pulled back from the element, particularly the forming wire into the inoperative- or servicing position in a process-reliable and reproducible manner.

In addition, the friction between the guide surfaces of the lateral guides and the movable bar, particularly the forming bar causes said bar—not only at a slightly slanted installation position to not always be pulled back reliably from the element, particularly the forming wire through gravitation when discharging the medium from the actuation device.

What is needed in the art is to further develop a bar arrangement of the type referred to at the beginning so that the known disadvantages of the state of the art are largely, preferably completely removed. In particular, a process-reliable, reproducible and preferably cost effective retraction of the movable bar should be possible, particularly also during operation of the machine for the production of a fibrous web.

SUMMARY OF THE INVENTION

The present invention provides, regarding a bar arrangement of the type referred to at the beginning, at least one return mechanism to bring the movable bar from the operating position into the inoperative position, whereby the at least one return mechanism comprises at least one guided part which is located on the outside and longitudinally on the movable bar and has a slanted ascending surface whose slant is aligned with the longitudinal direction of the movable bar at an angle below the range of 5 to 60°, preferably of 20 to 45°, especially of 25 to 35°; at least one guiding part located on the inside of the c-shaped guide unit which has preferably a slanted guide surface which can be brought into contact with the slanted ascending surface of the guided part which is provided on the outside and longitudinally on the movable bar, when the movable bar is moved from the operating position into the inoperative position; and at least one preferably controllable/adjustable moving apparatus which preferably acts upon the face side of the movable bar in order to move the movable bar in its longitudinal direction.

The inventive bar arrangement with the described return mechanism totally removes the disadvantages of the current state of the art known to the expert. Also, the prerequisites are provided for a process-reliable, reproducible and cost-effective return of the movable bar, especially also during the operation of the machine for the production of a fibrous web.

The described return mechanism with the two conspiring parts and the moving apparatus causes a forced return of the movable bar from its operating position into its inoperative position.

The slant of the slanted ascending surface should be as level as possible in order to be able to keep the required return forces small. However, this necessitates a long lateral displacement path of the movable bar. This requirement is best met by the cited angle ranges for the slant.

In a first preferred embodiment the guided part with the slanted ascending surface which is located on the outside and longitudinally at the movable bar is at least a single-part plate which is connected detachably with the movable bar, especially screwed down or non-detachably, especially glued.

Because of the possible detachability of the at least single-part plate, simple replacement of same, for example due to wear and tear, is simple, fast and cost-effective. The plate may of course also be a multipart component. The plate may for example include a plate base body and an ascending surface body which may consist of a material having special gliding properties. The two bodies can be connected with each other by means, for example, of at least one screw, or glue or similar type connection.

In a second preferred embodiment the guided part with the slanted ascending surface which is located on the outside and longitudinally at the movable bar is machined, preferably milled, or non-machined, preferably formed into the movable bar. This causes a solid connection with the movable bar, has however the disadvantage that the slant can only be conditionally changed retrospectively. Since the movable bar, especially its support bar, is manufactured from glass fiber reinforced synthetic material (pultrusion profile) the glass fibers which are mostly oriented in longitudinal direction are nicked during milling. These cut surfaces must then be sealed against possible water penetration. The gliding contact between slant and guide arm therefore occurs above the sensitive seal.

With both preferred embodiments the guided part with the slanted ascending surface which is located on the outside and longitudinally at the movable bar can be located in a groove extending in longitudinal direction of the movable bar. The groove has a depth which is equal or approximately equal to, especially slightly smaller than, the part height. Also, the groove may extend along the entire length of the movable bar. The advantage of this solution is that the groove in which the plates are fastened can be produced with an appropriately shaped tool directly during the manufacture of the bar. Therefore, no expensive milling work is involved, and sealing of cut edges is not necessary. In addition, the plate can be quickly changed out when worn, or if changes occur.

In addition, the slanted ascending surface of the part located on the outside and longitudinally at the movable bar consists advantageously of a material which has good gliding properties. This material can have a friction coefficient $\mu \leqq 0.3$, preferably $\leqq 0.2$, especially $\leqq 0.15$. The part with the slanted ascending surface located on the outside and longitudinally at the movable bar can be a separate part mounted on the movable bar, or an integral part of the movable bar.

And the guiding part with the preferably slanted guiding surface located on the inside of the c-shaped guide unit is arranged preferably on a fixed guide arm. Here the preferred slant of the guiding surface on the fixed guide arm can be aligned to the longitudinal direction of the movable bar at an angle in the range of less than 5 to 60°, preferably 20 to 45°, especially 25 to 35°. This allows for a simple and inexpensive construction with good operational properties. Usefully, the angle assumes a lower value at the slant of the guiding surface than at the ascending surface of the part.

Here it is advantageous if the one fixed guide arm of the c-shaped guide unit which preferably has a slanted guide surface is shorter than the at least one other fixed guide arm of the c-shaped guide unit which is located opposite of the movable bar. This dimension can be in the range of 5 to 50 mm, preferably 10 to 40 mm, especially 20 to 30 mm.

The bar arrangement further has an ascending side where the element moves onto the movable bar and a descending side where the element moves off the movable bar.

The at least one return mechanism to bring the movable bar from the operating position into the inoperative position in this instance is arranged preferably at the ascending side of the movable bar. The fixed guide arm which is located on the descending side of the movable bar can therefore be longer, thereby achieving more efficient guiding of the movable bar, especially in regard to tipping stability.

In regard to an operationally appropriate design of the bar arrangement several return mechanisms are preferably provided to return the movable bar from the operating position into the inoperative position whereby they are arranged uniformly, preferably at even repeats of the c-shaped guide units, or at random. They may for example be located at each, every second, every third or even on every fourth c-shaped guide unit. As already mentioned they may of course also be arranged at random or possibly in a pattern.

In addition, the movable bar which includes an upper top bar which guides the element and a bottom support bar is equipped at the bottom side in the area of its support bar with several slots which are located preferably at equal distances from each other. This provides for a less rigid embodiment of the movable bar with the result that it can better conform transversely against the element.

The single moving apparatus ideally includes at least one drive unit with preferably a linear moving direction—for example a pneumatic or hydraulic cylinder, a linear motor, a crank mechanism or similar device. Drive units of this type have proven themselves many times in similar applications and sufficiently meet the requirements presented to them. The moving apparatus influencing the movable bar acts preferably on the front side of the movable bar; it could obviously also be located along the movable bar and act upon it directly or indirectly.

In a preferred embodiment the actuation device includes at least one tube, filled with a liquid or gaseous medium, a pneumatic or hydraulic cylinder, a V-drive, an eccentric, or another similar lifting element. Particularly a tube filled with a gaseous medium has already proven itself in other similar applications, especially in regard to the functional reliability.

The inventive bar arrangement can also be part of a wire section for a machine for the production of a fibrous web, especially a paper, cardboard or tissue web. Here, like bar arrangements are provided which are located parallel to each other and extend transversely to the machine direction; in other words they are identical in design. In addition, each movable bar which comprises an upper top bar which guides the element and a bottom support bar is equipped at the bottom side in the area of its support bar with several slots which are located preferably at equal distances from each other. Two directly adjacent and movable bars are arranged parallel to each other so that, in the operating position of the movable bar their respective slots are offset against each other, preferably center offset so that markings in the fibrous web which is to be produced are largely avoided. If they would not be offset with each other then the same rigid areas of the bars in machine direction would be positioned aligned with each other. This could result in markings in the fibrous web which is to be produced.

However, with the described wire section the problem arises that for the first, third, etc., and the second, fourth, etc. movable bar theoretically different movable bars must be used so that the slots are arranged offset to each other. If the same movable bars were to be used and were only to be offset laterally without further measures then the actuation device—viewed from the center of the wire section—would act upon different lengths. The edge areas would therefore be processed with varying forces which could again have a negative effect upon the achievable quality of the fibrous web which is to be produced. In order to alleviate this, the individual movable bar is now equipped on the bottom side in its offset area with regard to its at least one directly adjacent and movable bar with at least one filler piece located on the support bar. Viewed in machine direction the filler piece is located left on a movable bar and on the right on the next movable bar so that—viewed from the center of the wire section—always the same width X is used on the movable bars. The lateral projection of the movable bars to one side is irrelevant since it is outside the element. In this way the same base bar, in other words bars of identical design can be used for all movable bars within one wire section. On changeover of movable bars possibly only the filler pieces need to be moved from left to right or respectively from right to left. According to this solution the movable bars can be produced more cost effectively due to the larger number of same parts that are being produced. Moreover, fewer spare bars are required since there are not two different bar variations.

The inventive bar arrangement is suited ideally for use in a machine for the production of a fibrous web, particularly a paper, cardboard or tissue web. Also a wire section which utilizes the inventive bar arrangement is ideally suited for use in a machine for the production of a fibrous web, particularly a paper, cardboard or tissue web.

In the field of paper industry, especially in the area of paper manufacturing and converting there are several corresponding design forms for the movable bar and the element. The movable bar may be a forming bar or a dewatering bar which consists at least of a top bar which is in contact with the element and a support bar which is rigidly connected with the top bar. The element may be a forming wire in a wire section for a machine for the production of a fibrous web. The movable bar may also be an oil scraper bar and the element may be a press roll in a press section for a machine for the production of a fibrous web. And lastly, but not finally, the movable bar may be a scraper and the element may be a roll or a cylinder in a wire-, press- or drying section of a machine for the production of a fibrous web.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1:
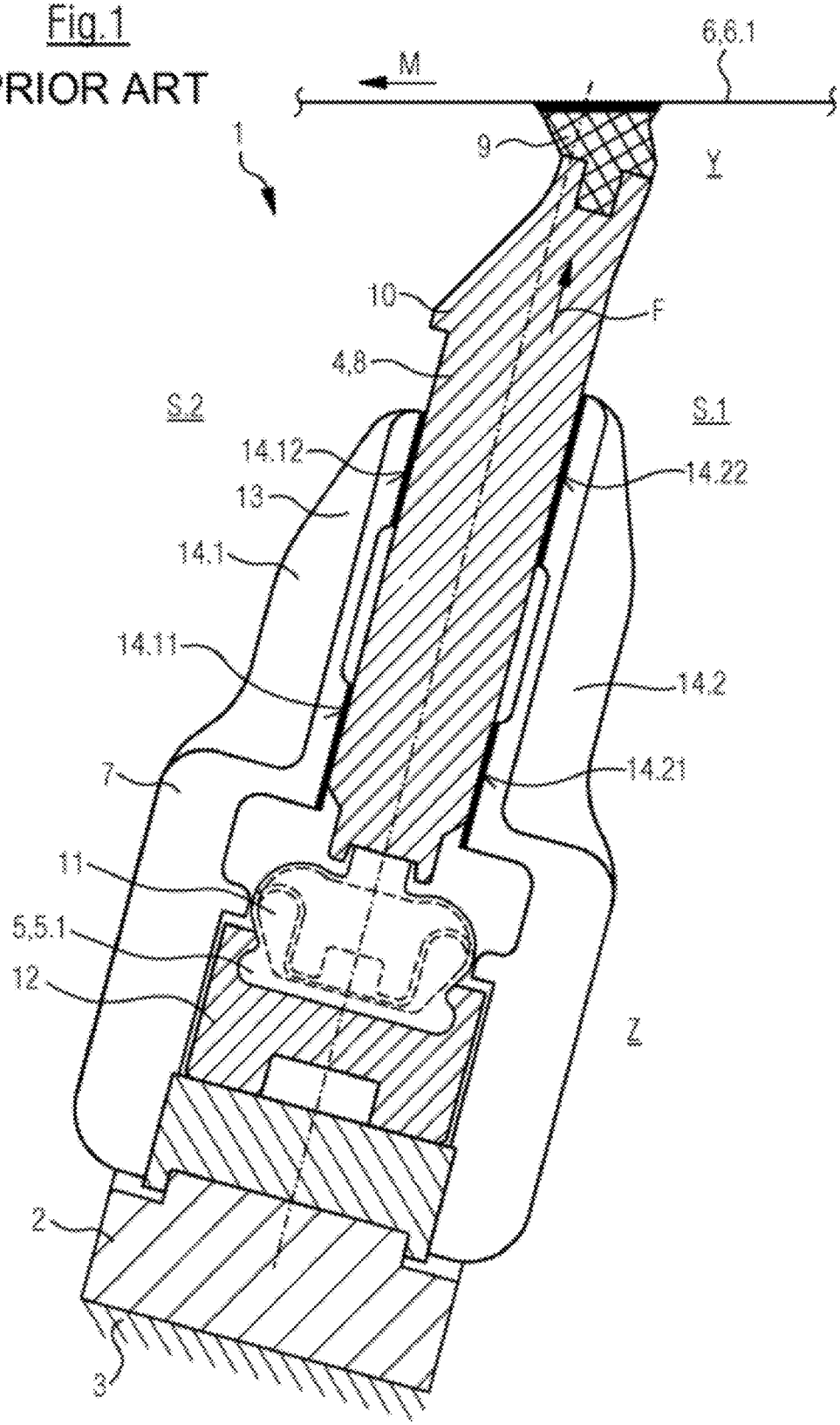
Fig.1 PRIOR ART
FIG. 1 is a schematic cross sectional view of a bar arrangement for a machine for the production of a fibrous web according to the current state of the art.

Referring now to the drawings, and more particularly to FIG. 1, there is shown a schematic cross sectional view of a bar arrangement 1 for a machine for the production of a fibrous web which is not illustrated in further detail in this drawing. The fibrous web may in particular be a paper, cardboard or tissue web.

Bar arrangement 1 extends transversely to machine direction M (arrow) and includes a fixed structure 2 which is mounted directly or indirectly to a machine frame 3 (which is merely indicated). It also includes a movable bar 4 which is connected indirectly with fixed structure 2 and is movable in reference to this by preferably a controllable/adjustable operating device 5 at least between a depicted operating position Y in which movable bar 4 can be pressed against an element 6 by means of a selectable contact force F (arrow) and an inoperative position Z which is not shown but which is known to the expert. Inoperative position Z can here be consistent with the servicing position in which service and replacement work of any kind can be conducted on bar arrangement 1.

Bar arrangement 1 also includes a fixed guide unit 7 which—in the illustrated design—is rigidly mounted on fixed structure 2 or, in a design which is not illustrated here, is mounted directly or indirectly on machine frame 3 and exerts a guiding effect upon movable bar 4.

The illustrated bar arrangement 1 includes, merely as an example, a forming bar or dewatering bar 8 as the movable bar 4 which consists at least of one top bar 9 which contacts element 6 and a support bar 10 which is rigidly connected with top bar 9. And, element 6 is a forming wire 6.1 in a wire section for a machine for the production of a fibrous web. Normally a fibrous stock suspension which is not shown here would be present on element 6 which here is in the embodiment of forming wire 6.1. In additional design variations which are not explicitly shown here but which are known to the expert, movable bar 4 may also be in the embodiment of an oil scraper bar and the element may be a press roll in a press section for a machine for the production of a fibrous web. In addition, movable bar 4 may also be a scraper and the element may be a roll or a cylinder in a wire-, press- or drying section of a machine for the production of a fibrous web.

In the illustrated design variation, actuation device 5 is a tube 5.1 filled with a liquid or gaseous medium 11 which, on the bottom side and at least in regions, is guided laterally in a shell 12. It may however also be an already known pneumatic or hydraulic cylinder, a V-drive, an eccentric or another similar lifting element.

Fixed guiding device 7 includes several fixed c-shaped guide units 13 which are located at distances from each other and which surround movable bar 4 at least partially in its lower area on one side with respectively one fixed guide arm 14.1, 14.2 and which, through guide surfaces 14.11, 14.12, 14.21 and 14.22, exert the guiding effect upon movable bar 4. The four illustrated guide surfaces 14.11, 14.12, 14.21 and 14.22 are emphasized on the drawing.

Bar arrangement 1 with movable bar 4 has an ascending side S.1 on which element 6 runs onto movable bar 4, and a descending side S.2 on which element 6 runs off movable bar 4.

Figure 2A:
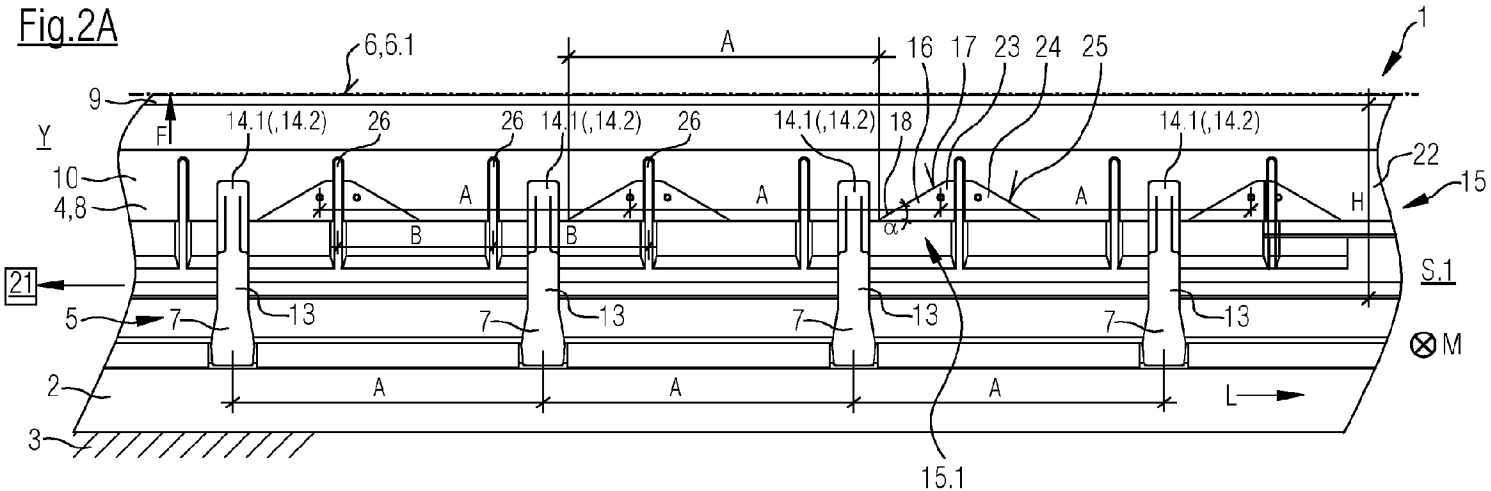
FIG. 2A is a schematic partial longitudinal view of one design form of an inventive bar arrangement for a machine for the production of a fibrous web in one operating position.

FIG. 2A shows a schematic partial longitudinal view of one design variation of an inventive bar arrangement 1 for a machine for the production of a fibrous web in an operating position Y. The ascending side S.1 of bar arrangement 1 is shown.

This bar arrangement 1 extends transversely to machine direction M (arrow) and includes a fixed structure 2 which is mounted directly or indirectly on a machine frame 3 which is merely indicated here. It also includes a movable bar 4 which is connected indirectly with the fixed structure 2 and is movable in reference to this by preferably a controllable/adjustable actuation device 5 at least between a depicted operating position Y in which the movable bar 4 can be pressed against an element 6 by means of a selectable contact force F (arrow) and an inoperative position Z (compare FIG. 2B) which is not shown but which is known to the expert. Inoperative position Z can here be consistent with the servicing position in which service and replacement work of any kind can be conducted on the bar arrangement 1.

Bar arrangement 1 also includes a fixed guide unit 7 which, in the illustrated design, is rigidly mounted on the fixed structure 2 or, in the design which is not illustrated here, is mounted directly or indirectly on machine frame 3 and exerts a guiding effect upon movable bar 4.

The illustrated bar arrangement 1 includes, merely as an example, a forming bar or dewatering bar 8 as the movable bar 4 which consists at least of one top bar 9 which contacts element 6 and a support bar 10 which is rigidly connected with top bar 9.

And, element 6 is a forming wire 6.1 in a wire section for a machine for the production of a fibrous web. Normally a fibrous stock suspension which is not shown here would be present on element 6 which here is in the embodiment of forming wire 6.1. In additional design variations which are not explicitly shown here but which are known to the expert, the movable bar 4 may also be in the embodiment of an oil scraper bar and the element may be a press roll in a press section for a machine for the production of a fibrous web. In addition, movable bar 4 may also be a scraper and the element may be a roll or a cylinder in a wire-, press- or drying section of a machine for the production of a fibrous web.

As already known, actuation device 5 is a tube 5.1 filled with a liquid or gaseous medium 11 which, on the bottom side and at least in regions, is guided laterally in a shell 12 (compare FIG. 1). It may however also be an already known pneumatic or hydraulic cylinder, a V-drive, an eccentric or another similar lifting element.

The fixed guiding device 7 includes several fixed c-shaped guide units 13 which are located at distances from each other and which surround the movable bar 4 at least partially in its lower area on one side with respectively one fixed guide arm 14.1, 14.2 and which, through guide surfaces 14.11, 14.12, 14.21 and 14.22 (compare FIGS. 4 and 5), exert the guiding effect upon movable bar 4. The four illustrated guide surfaces 14.11, 14.12, 14.21 and 14.22 are emphasized on the drawing.

Figure 2B:
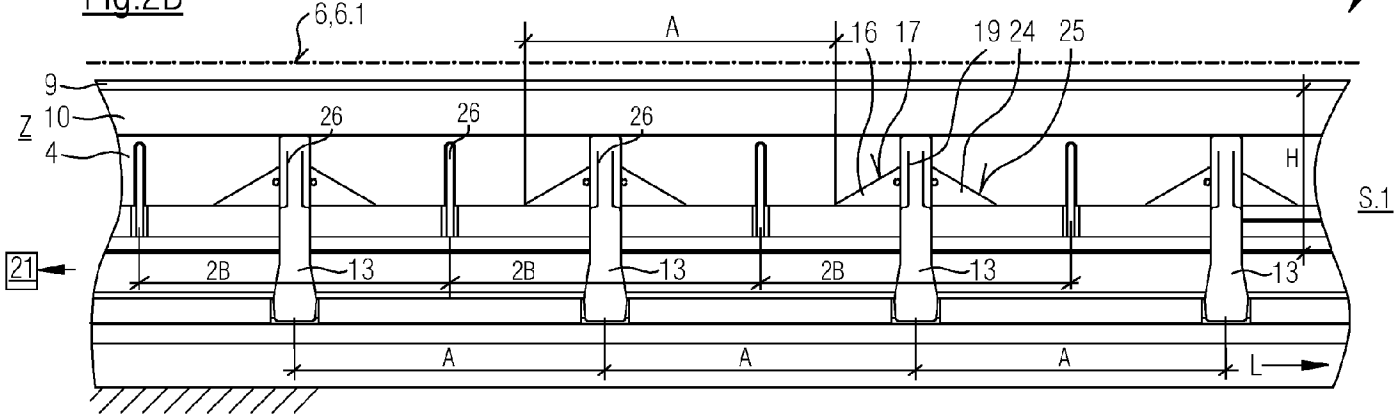
FIG. 2B is the inventive bar arrangement illustrated in FIG. 2A for a machine for the production of a fibrous web in an inoperative position.

Also at least one return mechanism 15 is provided in this bar arrangement 1 in order to move the movable bar 4 from the operating position Y into the inoperative position Z (compare FIG. 2B). In the illustrated design variation only one component unit 15.1 of return mechanism 15 is referenced as an example.

Return mechanism 15 includes several guided parts 16 (compare also FIG. 4) which are positioned at a distance from each other and are arranged longitudinally on the outside of movable bar 4, having respective slanted ascending surfaces 17 whose slant 18 is aligned to the longitudinal direction L (arrow) of the movable bar 4 at less than an angle $\alpha$ in a range of 5 to 60°, preferably 20 to 45°, especially 25 to 35°. The return mechanism 15 further includes several guiding parts 19 (compare FIGS. 4 and 5) located at distance from each other on the inside of the single and immediately adjacent c-shaped guide unit 13 and having preferably a slanted guide surface 20 which can be brought into contact with slanted ascending surface 17 of the respectively guided part 16 which is provided on the outside and longitudinally on movable bar 4 when movable bar 4 is moved from operating position Y into inoperative position Z (compare FIG. 2B). Return mechanism 15 further includes at least one preferably controllable/adjustable moving device 21 which acts upon the face side of movable bar 4 in order to move movable bar 4 in longitudinal direction L (arrow). Moving apparatus 21 is indicated merely schematically by an arrow. As is already known it includes at least one drive unit with preferably a linear moving direction—for example a pneumatic or hydraulic cylinder, a linear motor, a crank mechanism or similar device.

The respective guided part 16 with slanted ascending surface 17 which is located on the outside and longitudinally at movable bar 4 is located in a groove 22 (compare also FIG. 4) extending in longitudinal direction L (arrow) of movable bar 4. In the illustrated design variation groove 22 extends along the entire length of movable bar 4 and has a groove depth 22.T which is preferably equal or approximately equal to, especially slightly smaller than, the part height 16.T (compare FIG. 4).

FIG. 2B illustrates the inventive bar arrangement 1 for a machine for the production of a fibrous web which is shown in FIG. 2A in an inoperative position Z. Again, element 6, in particular forming wire 6.1, is merely indicated with a dash-dot-dash line. The ascending side S.1 of bar arrangement 1 is shown.

Movable bar 4 was moved from the operating position Y (compare FIG. 2A) into the inoperative position Z by means of the preferably controllable/adjustable moving device 21 which acts upon the face side and serves to move movable bar 4 in its longitudinal direction L (arrow). The several guided parts 16 (compare also FIG. 4) which are positioned at a distance from each other and which are located on the outside and longitudinally at movable bar 4 and have a respective slanted ascending surface 17 were brought into contact with the several guiding parts 19 (compare FIGS. 4 and 5) which are positioned at a distance from each other and are located inside on the single and immediately adjacent c-shaped guide unit 13. Based on the contact between parts 16, 19 and slanted surfaces 17, possibly in connection with slanted surfaces 20 (compare FIGS. 4 and 5), movable bar 4 was moved between the two positions Y, Z and thereby lifted by element 6.

It can also be seen in the two FIGS. 2A and 2B that in mirror image to parts 16 with the slanted ascending surfaces 17 additional parts 24 with slanted surfaces 25 are provided. These parts 24 with their slanted surfaces 25 essentially serve exclusively to reliably move the movable bar 4 in and out in a machine for the production of a fibrous web. Their presence has no relevance for the current inventive layout of the bar arrangement 1.

Parts 16, 19 are advantageously arranged in uniform distribution on the movable bar 4. The uniform distribution may for example provide a respective distance A in the range of 150 to 1,000 mm, preferably 200 to 750 mm, especially 250 to 500 mm. Naturally they may also be arranged at any repeat c-shaped guide unit 13, or even at random. Also, the placement of the c-shaped guide units may be uniform or at random. Among other things this would depend upon occurring forces which among other situations also occur through redirecting the water jet scraped off by the element.

In addition, movable bar 4 which includes an upper top bar 9 which guides the element 6 and a bottom support bar 10 is equipped at the bottom side in the area of its support bar 10 with several slots 26 which are located preferably at equal distances B from each other. These slots 26 primarily serve the objective to render support bar 10 and thereby also movable bar 4 more flexible so that it can be pressed more easily against element 6. In addition, slots 26 extend over at least 25%, preferably at least 50%, of height H of support bar 10 and with regard to physical properties have an optimum cross sectional contour.

In addition, the slanted ascending surface 17 of part 16 which is located on the outside and longitudinally on movable strip 4 consists of a material with good gliding properties. This material can have a friction coefficient $\mu \leqq 0.3$, preferably $\leqq 0.2$, especially $\leqq 0.15$.

Also, the respective guided part 16 with slanted ascending surface 17 which is located on the outside and longitudinally at the movable bar 4 is at least one single-part plate 23 which is connected detachably by means of an indicated screw connection with movable bar 4. It can however be connected non-detachably with the movable bar.

Guided part 16 with slanted ascending surface 17 which is located on the outside and longitudinally at movable bar 4 is machined, preferably milled, or non-machined, preferably formed into movable bar 4. It can therefore also be an integral part of movable bar 4.

Figure 3:
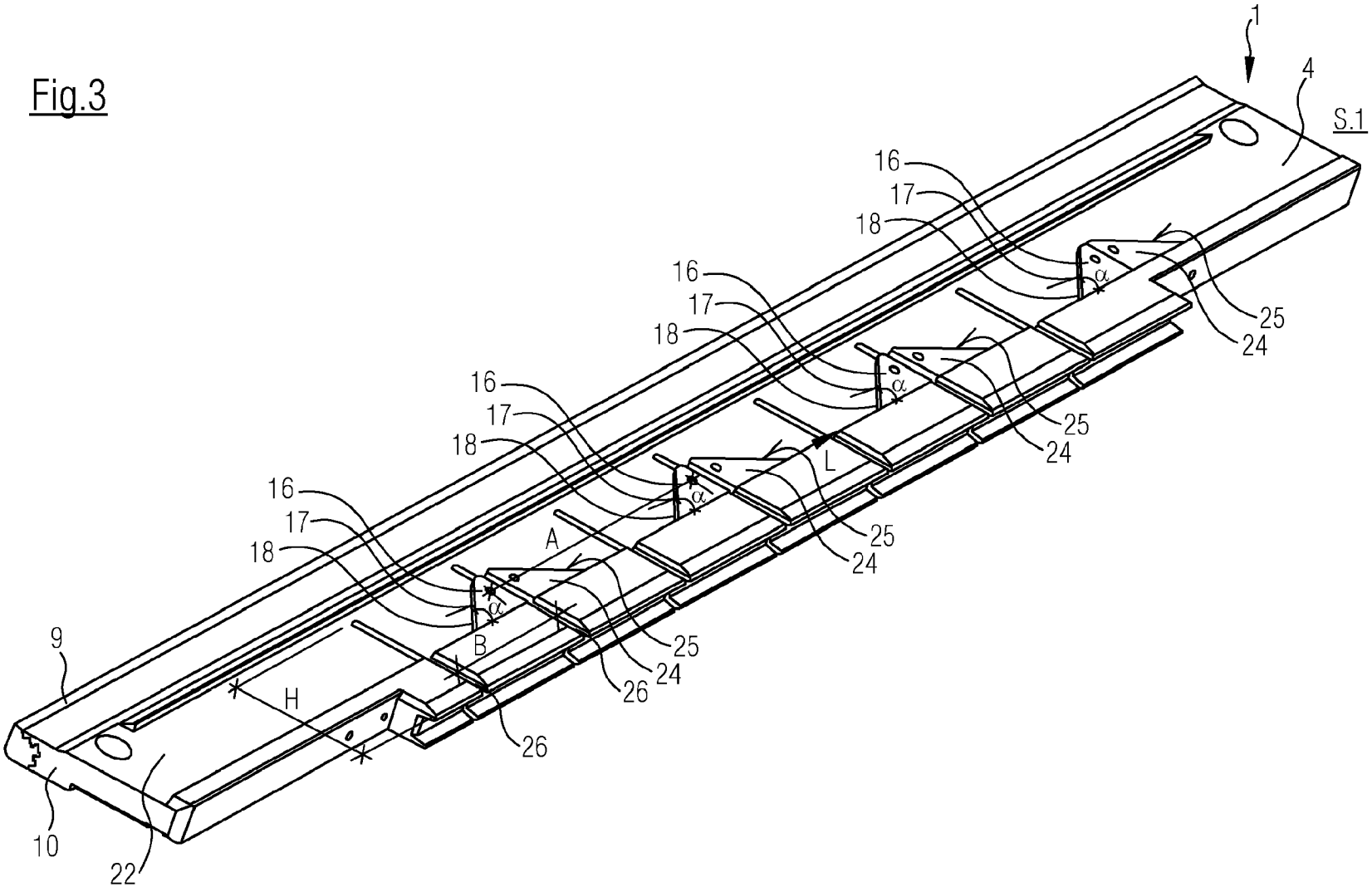
FIG. 3 is a schematic perspective view of the movable bar of the inventive bar arrangement illustrated in FIGS. 2A and 2B for a machine for the production of a fibrous web.

FIG. 3 shows a schematic perspective drawing of movable bar 4 of the inventive bar arrangement 1 illustrated in FIGS. 2A and 2B for a machine for the production of a fibrous web. Ascending side S.1 of bar arrangement 1 is shown.

Movable bar 4 comprises a top bar 9 and a support bar which is rigidly connected with top bar 9.

Return mechanism 15 includes several parts 16 which are guided, positioned at a distance from each other and are arranged longitudinally on the outside of movable bar 4, having respective slanted ascending surfaces 17 whose slant 18 is aligned to the longitudinal direction L (arrow) of movable bar 4 at less than an angle $\alpha$ in a range of 5 to 60°, preferably 20 to 45°, especially 25 to 35°.

The respective guided part 16 with the slanted ascending surface 17 which is located on the outside and longitudinally at movable bar 4 is located in a groove 22 extending in longitudinal direction L (arrow) of movable bar 4. In the illustrated design variation groove 22 extends along the entire length of movable bar 4 and has a groove depth 22.T which is preferably equal or approximately equal, especially slightly smaller than the part height 16.T (compare FIG. 4)

Parts 16 are advantageously arranged in uniform distribution on movable bar 4. The uniform distribution may for example provide a respective distance A in the range of 150 to 1,000 mm, preferably 200 to 750 mm, especially 250 to 500 mm.

In addition parts 24 with slanted surfaces 25 are provided in mirror image to parts 16 with the slanted ascending surfaces 17. These parts 24 with their slanted surfaces 25 essentially serve exclusively to reliably move movable bar 4 in and out in a machine for the production of a fibrous web.

In addition movable bar 4 is equipped at the bottom side in the area of its support bar 10 with several slots 26 which are located preferably at equal distances B from each other. These slots 26 primarily serve the objective to render support bar 10 and thereby also movable bar 4 more flexible. In addition, slots 26 extend over at least 25%, preferably at least 50%, of height H of support bar 10 and with regard to physical properties have an optimum cross sectional contour.

Figure 4:
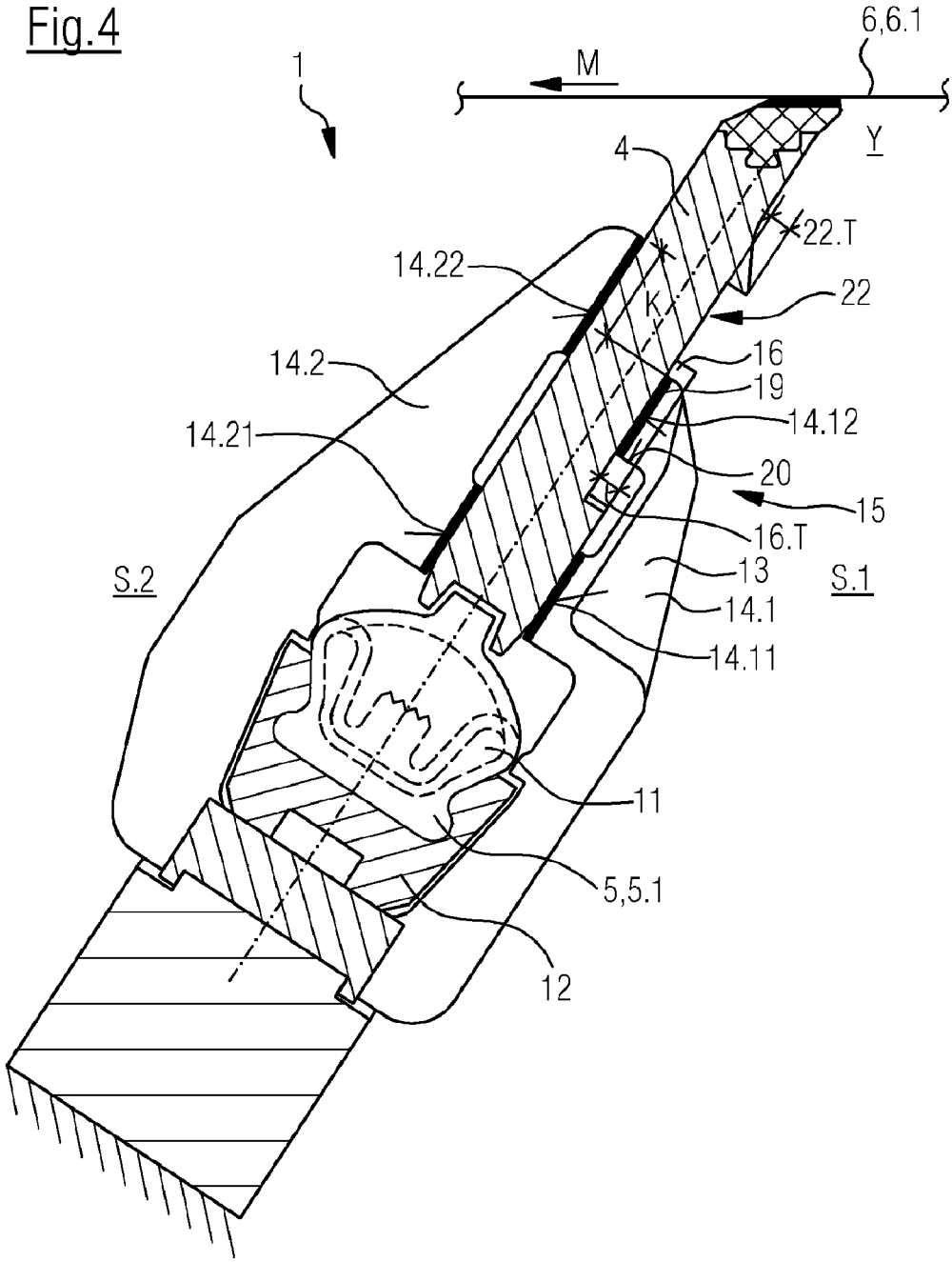
FIG. 4 is a schematic cross sectional view of the c-shaped guide unit of the inventive bar arrangement illustrated in FIGS. 2A and 2B for a machine for the production of a fibrous web.

FIG. 4 is a schematic cross sectional view of c-shaped guide unit 13 of the inventive bar arrangement 1 illustrated in FIGS. 2A and 2B for a machine for the production of a fibrous web.

The one fixed guide arm 14.1 of c-shaped guide unit 13 which preferably has a slanted guide surface 20 is shorter than the at least one other fixed guide arm 14.2 of c-shaped guide unit 13 which is located opposite of movable bar 4. This short dimension K can be in the range of 5 to 50 mm, preferably 10 to 40 mm, especially 20 to 30 mm.

The respective guided part 16 with the slanted ascending surface 17 which is located on the outside and longitudinally at movable bar 4 is located in a groove 22 extending in longitudinal direction L (arrow) of movable bar 4. In the illustrated design variation groove 22 extends along the entire length of movable bar 4 and has a groove depth 22.T which is preferably equal or approximately equal to, especially slightly smaller than, the part height 16.T.

It can also be seen that bar arrangement 1 extending transversely to machine direction M (arrow) with movable bar 4 has an ascending side S.1 on which element 6 runs onto movable bar 4, and a descending side S.2 on which element 6 runs off movable bar 4. The at least one return mechanism 15 which returns movable bar 4 from the operating position Y into the inoperative position Z which is not illustrated here, is located on the ascending side S.1. Theoretically, however, it could also be located on the descending side of the bar arrangement.

Actuation device 5 is a tube 5.1 which, as is known, is filled with a liquid or gaseous medium and which, on the bottom side and at least in regions, is guided laterally in a shell 12. It may however also be an already known pneumatic or hydraulic cylinder, a V-drive, an eccentric or another similar lifting element.

Figure 5:
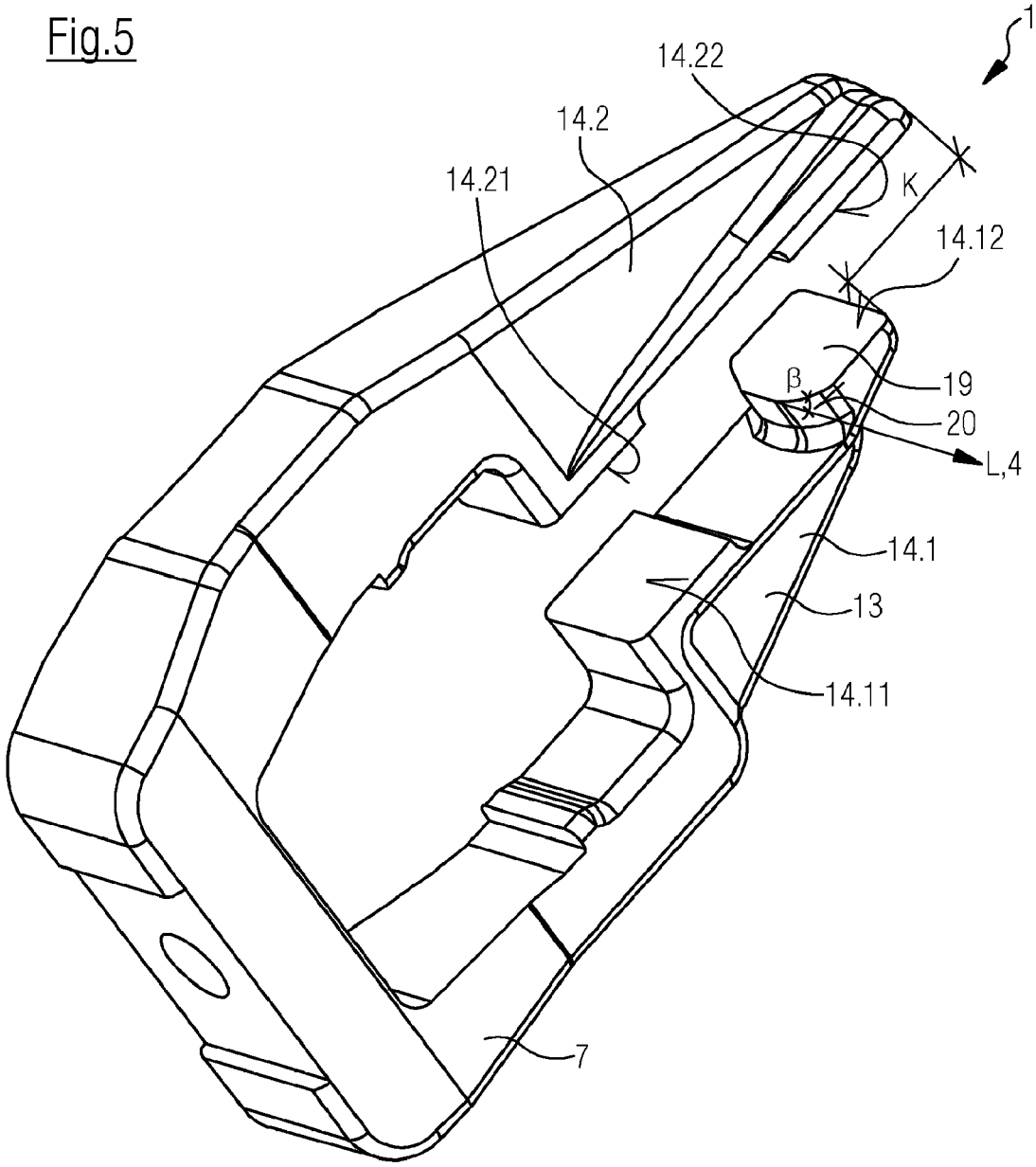
FIG. 5 is a schematic perspective view of the c-shaped guide units of the inventive bar arrangement illustrated in FIG. 4 for a machine for the production of a fibrous web.

FIG. 5 is a schematic perspective view of the c-shaped guide unit 13 of the inventive bar arrangement 1 illustrated in FIG. 4, for a machine for the production of a fibrous web.

The fixed c-shaped guide unit 13 of the fixed guide arrangement 7 includes two fixed guide arms 14.1, 14.2 which surround the movable bar (which is not illustrated) at least partially in its lower area, always on one side and which exert the guiding effect upon the movable bar 4 through guide surfaces 14.11, 14.12, 14.21 and 14.22.

As already mentioned the one fixed guide arm 14.1 of c-shaped guide unit 13 of the guide arrangement 7 which has a preferably slanted guide surface 20 is shorter than the at least one other fixed guide arm 14.2 of c-shaped guide unit 13 which is located opposite of movable bar which is not illustrated. This short dimension K can be in the range of 5 to 50 mm, preferably 10 to 40 mm, especially 20 to 30 mm.

Guiding part 19 which is arranged on the inside of the c-shaped guide unit 13 and which is equipped with the preferably slanted guide surface 20 is located at the short fixed guide arm 14.1. The preferred slant 27 of the guiding surface 20 on the fixed guide arm 14.1 is aligned to the longitudinal direction L (arrow) of the movable bar 4 at an angle $\beta$ in the range of less than 5 to 60°, preferably 20 to 45°, especially 25 to 35°. Usefully, angle $\beta$ assumes a lower value than angle $\alpha$.

Figure 6:
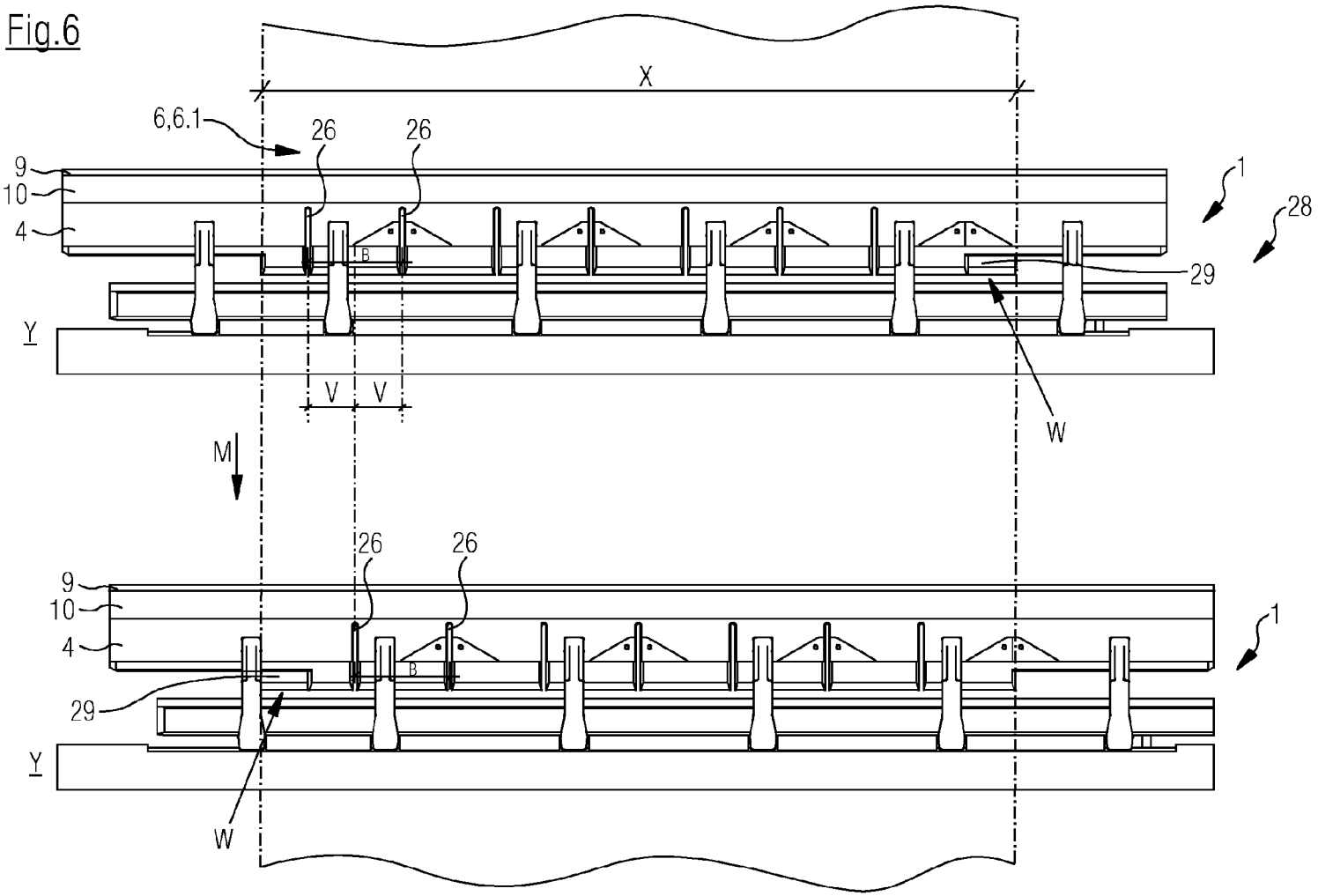
FIG. 6 shows two adjacently located bar arrangements of a wire section for a machine for the production of a fibrous web.

FIG. 6 shows two adjacent bar arrangements 1 in a wire section 28 for a machine for the production of a fibrous web. The fibrous web may in particular be a paper, cardboard or tissue web.

The illustrated wire section 28 includes two bar arrangements merely as an example. Also, additional parts and component groups of wire section 28 are not illustrated for the sake of providing a clear overview.

The respective bar arrangement 1 of wire section 28 is inventively executed as illustrated and described in FIGS. 2A, 2B, 3, 4 and 5. Each movable bar 4 which includes an upper top bar 9 which guides the element 6, especially forming wire 6.1 and a bottom support bar 10 is equipped at the bottom side in the area of its support bar 10 with several slots 26 which are located at equal distances B from each other.

In addition, the two directly adjacent and movable bars 4 are arranged parallel to each other so that, in the operating position Y of the movable bar 4 their respective slots 26 are arranged offset with each other, preferably center offset so that markings in the fibrous web which is to be produced are largely avoided. Offset V is preferably half the distance B between the two adjacent slots 26. In its one sided and outside offset area W the single movable bar 4 is equipped on the bottom side with at least one filler piece 29 on the support bar 10 with regard to its at least one directly adjacent and movable bar 4.

Viewed in machine direction M (arrow) the single filler piece 29 is arranged on a movable bar 4 on the left and on the following movable filler bar 4 on the right so that—viewed from the center of wire section 28—always the same width X on movable bars 4 is used. This results in the already discussed advantages.

In addition bar arrangement 1 illustrated in FIGS. 2A, 2B, 3, 4 and 5 and wire section 28 illustrated in FIG. 6 are ideally suited for use in a machine for the production of a fibrous web, especially a paper, cardboard or tissue web.

As already explained, the illustrated actuation device 5 can be a tube 5.1 in all design forms, filled with a liquid or gaseous medium 11, a pneumatic or hydraulic cylinder, a V-drive, an eccentric or another similar lifting element.

In general, movable bar 4 may be a forming bar or dewatering bar 8, an oil scraper bar or a scraper. In contrast element 6 may be a forming wire 6.1 in a wire section for a machine for the production of a fibrous web, a press roll in a press section for a machine for the production of a fibrous web or a roll or cylinder in a wire-, press- or drying section for a machine for the production of a fibrous web. Movable bar 4 and element 6 come particularly from the paper industry, particularly from the field of paper manufacturing and paper converting.

In summary it should be stated that through the invention a bar arrangement of the type referred to at the beginning is further developed, so that the known disadvantages of the state of the art are largely, preferably even totally removed. In particular, a process-reliable, reproducible and cost effective retraction of the movable bar is made possible, particularly also during operation of the machine for the production of a fibrous web.

Component Identification List

1 Bar arrangement
2 Fixed structure
3 Frame
4 Movable bar
5 Operating device
5.1 Tube
6 Element
6.1 Forming wire
7 Guide arrangement
8 Forming or dewatering bar
9 Top bar
10 Support bar
11 Medium
12 Shell
13 Guide unit
14.1 Guide arm
14.2 Guide arm
14.11 Guide surface
14.12 Guide surface
14.21 Guide surface
14.22 Guide surface
15 Return mechanism
15.1 Component unit
16 Part
16.T Partial height
17 Slanted ascending surface
18 Slant
19 Part
20 Guide surface
21 Moving device
22 Groove
22.T Groove depth
23 Plate
24 part
25 Slanted surface
26 Slot
27 Slant
28 Wire section
29 Filler piece
A Distance
B Distance
F Contact force (arrow)
H Height
K Short dimension
L Longitudinal direction (arrow)
M Machine direction (arrow)
S.1 Ascending side
S.2 Descending side
V Offset
W Offset range
X Width
Y Operating position
Z Inoperative position
α Angle
β Angle While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A bar arrangement for a machine for producing a web of fibrous material, the web being one of a paper web, a cardboard web, and a tissue web, the machine including a frame, said bar arrangement comprising:

at least one fixed structure which is mounted one of directly and indirectly to the frame of the machine, the bar arrangement extending transversely to a machine direction;

an actuation device;

at least one movable bar which is connected with said fixed structure and which includes a lower area, a plurality of sections, a side, an outside, and a longitudinal direction, said movable bar being movable, relative to said fixed structure, by way of said actuation device at least between an inoperative position and an operating position in which said movable bar is configured for being pressed against an element by way of a selectable contact force;

at least one fixed guide device which is mounted rigidly one of (a) on said fixed structure and (b) one of directly and indirectly on the frame of the machine, said fixed guide device having a guiding effect upon said movable bar and including a plurality of fixed c-shaped guide units located at a distance from each other, said plurality of fixed c-shaped guide units including an inside and a plurality of fixed guide arms, said plurality of fixed c-shaped guide units surrounding one said side of said movable bar in said lower area of said movable bar, at least in said plurality of sections, with said plurality of fixed guide arms; and at least one return mechanism configured for bringing said movable bar from said operating position into said inoperative position, said return mechanism including at least one guided part, at least one guiding part, and at least one moving apparatus, said guided part being located on said outside of and longitudinally on said movable bar, said guided part having a slanted ascending surface with a slant which is aligned with said longitudinal direction of said movable bar at an angle in a range below 5° to 60° , said guiding part located on said inside of a respective one of said plurality of fixed c-shaped guide units, said guiding part being configured for being brought into contact with said slanted ascending surface of said guided part while said movable bar is moved from said operating position into said inoperative position, said moving apparatus being configured for acting upon said movable bar in order to move said movable bar in said longitudinal direction of said movable bar, said longitudinal direction of said movable bar extending in a cross-machine direction.

2. The bar arrangement according to claim 1, wherein said movable bar is connected indirectly with said fixed structure.

3. The bar arrangement according to claim 1, wherein said actuation device is at least one of controllable and adjustable.

4. The bar arrangement according to claim 1, wherein said slant is aligned with said longitudinal direction of said movable bar at an angle in a range of 20° to 45°.

5. The bar arrangement according to claim 1, wherein said slant is aligned with said longitudinal direction of said movable bar at an angle in a range of 25° to 35 °.

6. The bar arrangement according to claim 1, wherein said at least one moving apparatus is at least one of controllable and adjustable.

7. The bar arrangement according to claim 1, wherein said guiding part has a slanted guiding surface which is configured for being brought into contact with said slanted ascending surface of said guided part while said movable bar is moved from said operating position into said inoperative position.

8. The bar arrangement according to claim 1, wherein said movable bar includes a face side, said moving apparatus configured for acting upon said face side of said movable bar in order to move said movable bar in said longitudinal direction of said movable bar.

9. The bar arrangement according to claim 1, wherein said guided part with said slanted ascending surface is at least a single-part plate which is connected detachably with said movable bar.

10. The bar arrangement according to claim 9, wherein said single-part plate is screwed down onto said movable bar.

11. The bar arrangement according to claim 1, wherein said guided part with said slanted ascending surface is at least a single-part plate which is connected non-detachably with said movable bar.

12. The bar arrangement according to claim 11, wherein said single-part plate is glued to said movable bar.

13. The bar arrangement according to claim 1, wherein said guided part with said slanted ascending surface is at least one of machined, milled, non-machined, and formed into said movable bar.

14. The bar arrangement according to claim 1, wherein said guided part with said slanted ascending surface is at least a single-part plate which is connected one of detachably and non-detachably with said movable bar, said movable bar including a groove extending in said longitudinal direction of said movable bar, said guided part with said slanted ascending surface being located in said groove extending in said longitudinal direction of said movable bar, said groove having a depth which is one of equal to and approximately equal to a height of said guided part.

15. The bar arrangement according to claim 14, wherein said movable bar includes a groove extending in said longitudinal direction of said movable bar, said guided part with said slanted ascending surface being located in said groove extending in said longitudinal direction of said movable bar, said groove having a depth which is slightly smaller than a height of said guided part.

16. The bar arrangement according claim 1, wherein said slanted ascending surface of said guided part consists of a material which has good gliding properties.

17. The bar arrangement according to claim 1, wherein said guiding part has a slanted guiding surface which is configured for being brought into contact with said slanted ascending surface of said guided part while said movable bar is moved from said operating position into said inoperative position, each of said plurality of fixed guide arms including a first fixed guide arm, said guiding part with said slanted guiding surface being arranged on a respective said first fixed guide arm, said slanted guiding surface including a slant, said slant of said slanted guiding surface on said respective first fixed guide arm being aligned to said longitudinal direction of said movable bar at an angle in a range of less than 5° to 60°.

18. The bar arrangement according to claim 17, wherein said slant of said slanted guiding surface on said respective first fixed guide arm is aligned to said longitudinal direction of said movable bar at an angle in a range of 20° to 45°.

19. The bar arrangement according to claim 17, wherein said slant of said slanted guiding surface on said respective first fixed guide arm is aligned to said longitudinal direction of said movable bar at an angle in a range of 25° to 35°.

20. The bar arrangement according to claim 17, wherein each of said plurality of fixed guide arms includes a second fixed guide arm, said respective first fixed guide arm of said respective one of said plurality of fixed c-shaped guide units which has said slanted guiding surface is shorter than a respective said second fixed guide arm of said respective one of said plurality of fixed c-shaped guide units which is located opposite of said movable strip.

21. The bar arrangement according to claim 1, wherein the bar arrangement has an ascending side where said element moves onto said movable strip and a descending side where said element moves off of said movable strip, said return mechanism, to bring said movable strip from said operating position into said inoperative position, being arranged at said ascending side.

22. The bar arrangement according to claim 1, further including a plurality of said return mechanism which are configured for returning said movable strip from said operating position into said inoperative position, said plurality of said return mechanism being arranged one of uniformly and at random.

23. The bar arrangement according to claim 22, wherein said plurality of said return mechanism are arranged uniformly at even repeats of said plurality of fixed c-shaped guide units.

24. The bar arrangement according to claim 1, wherein said movable bar includes an upper top bar, a bottom support bar, a bottom side, and an area associated with said bottom support bar, said upper top bar being configured for guiding said element, said movable bar being equipped at said bottom side in said area associated with said bottom support bar with a plurality of slots.

25. The bar arrangement according to claim 1, wherein said plurality of slots are located at equal distances from each other.

26. The bar arrangement according to claim 1, wherein said moving apparatus includes at least one drive unit.

27. The bar arrangement according to claim 26, wherein said at least one drive unit has a linear moving direction.

28. The bar arrangement according to claim 26, wherein said at least one drive unit includes at least one of a pneumatic cylinder, a hydraulic cylinder, a linear motor, and a crank mechanism.

29. The bar arrangement according to claim 1, wherein said actuation device includes at least one of (a) at least one tube (5.1) filled with one of a liquid medium and a gaseous medium, (b) a pneumatic cylinder, (c) a hydraulic cylinder, (d) a V-drive, (e) an eccentric, and (f) a lifting element which is not one of (a), (b), (c), (d), and (e).

30. A wire section for a machine for producing a web of fibrous material, the web being one of a paper web, a cardboard web, the machine including a frame, said wire section comprising:

a plurality of bar arrangements which are located parallel to each other and are identical in design relative to one another, each of said plurality of bar arrangements extending transversely to a machine direction and including:

at least one fixed structure which is mounted one of directly and indirectly to the frame of the machine;

an actuation device;

at least one movable bar which is connected with said fixed structure and which includes a lower area, a plurality of sections, a side, an outside, a longitudinal direction, an upper top bar, a bottom support bar, a bottom side, and an area associated with said bottom support bar, said movable bar being movable, relative to said fixed structure, by way of said actuation device at least between an inoperative position and an operating position in which said movable bar is configured for being pressed against an element by way of a selectable contact force, said upper top bar being configured for guiding said element, said movable bar being equipped at said bottom side in said area associated with said bottom support bar with a plurality of slots which are located at equal distances from each other;

at least one fixed guide device which is mounted rigidly one of (a) on said fixed structure and (b) one of directly and indirectly on the frame of the machine, said fixed guide device having a guiding effect upon said movable bar and including a plurality of fixed c-shaped guide units located at a distance from each other, said plurality of fixed c- shaped guide units including an inside and a plurality of fixed guide arms, said plurality of fixed c-shaped guide units surrounding one said side of said movable bar in said lower area of said movable bar, at least in said plurality of sections, with said plurality of fixed guide arms; and at least one return mechanism configured for bringing said movable bar from said operating position into said inoperative position, said return mechanism including at least one guided part, at least one guiding part, and at least one moving apparatus, said guided part being located on said outside of and longitudinally on said movable bar, said guided part having a slanted ascending surface with a slant which is aligned with said longitudinal direction of said movable bar at an angle in a range below 5° to 60° , said guiding part located on said inside of a respective one of said plurality of fixed c-shaped guide units, said guiding part being configured for being brought into contact with said slanted ascending surface of said guided part while said movable bar is moved from said operating position into said inoperative position, said moving apparatus being configured for acting upon said movable bar in order to move said movable bar in said longitudinal direction of said movable bar, said longitudinal direction of said movable bar extending in a cross-machine direction;

wherein two directly adjacent said movable bars are arranged parallel to each other so that, in said operating position of said directly adjacent movable bars, said plurality of slots of said directly adjacent movable bars are respectively offset against each other.

31. The wire section according to claim 30, wherein said two directly adjacent movable bars are arranged parallel to each other so that, in said operating position of said two directly adjacent movable bars, said plurality of slots of said two directly adjacent movable bars are respectively center offset against each other.

32. The wire section according to claim 30, wherein said two directly adjacent movable bars include a first said movable bar and a second said movable bar, said first movable bar being equipped on said bottom side of said first movable bar in an offset area of said first movable bar with regard to said second movable bar with at least one filler piece located on said support bar of said first movable bar.

33. A machine for producing a web of fibrous material, the web being one of a paper web, a cardboard web, the machine including a frame, said machine comprising:

at least one of:

(I) a bar arrangement including:

at least one fixed structure which is mounted one of directly and indirectly to the frame of the machine, the bar arrangement extending transversely to a machine direction;

an actuation device;

at least one movable bar which is connected with said fixed structure and which includes a lower area, a plurality of sections, a side, an outside, and a longitudinal direction, said movable bar being movable, relative to said fixed structure, by way of said actuation device at least between an inoperative position and an operating position in which said movable bar is configured for being pressed against an element by way of a selectable contact force;

at least one fixed guide device which is mounted rigidly one of (a) on said fixed structure and (b) one of directly and indirectly on the frame of the machine, said fixed guide device having a guiding effect upon said movable bar and including a plurality of fixed c-shaped guide units located at a distance from each other, said plurality of fixed c-shaped guide units including an inside and a plurality of fixed guide arms, said plurality of fixed c-shaped guide units surrounding one said side of said movable bar in said lower area of said movable bar, at least in said plurality of sections, with said plurality of fixed guide arms; and at least one return mechanism configured for bringing said movable bar from said operating position into said inoperative position, said return mechanism including at least one guided part, at least one guiding part, and at least one moving apparatus, said guided part being located on said outside of and longitudinally on said movable bar, said guided part having a slanted ascending surface with a slant which is aligned with said longitudinal direction of said movable bar at an angle in a range below 5° to 60° , said guiding part located on said inside of a respective one of said plurality of fixed c-shaped guide units, said guiding part being configured for being brought into contact with said slanted ascending surface of said guided part while said movable bar is moved from said operating position into said inoperative position, said moving apparatus configured for acting upon said movable bar in order to move said movable bar in said longitudinal direction of said movable bar, said longitudinal direction of said movable bar extending in a cross-machine direction; and (II) a wire section including:

a plurality of said bar arrangement, said plurality of bar arrangements being located parallel to each other and being identical in design relative to one another, said movable bar of each of said plurality of bar arrangements including an upper top bar, a bottom support bar, a bottom side, and an area associated with said bottom support bar, said upper top bar being configured for guiding said element, said movable bar being equipped at said bottom side in said area associated with said bottom support bar with a plurality of slots which are located at equal distances from each other; wherein two directly adjacent said movable bars are arranged parallel to each other so that, in said operating position of said directly adjacent movable bars, said plurality of slots of said directly adjacent movable bars are respectively offset against each other.

* * * * *